US011478810B2

(12) United States Patent
Oda

(10) Patent No.: US 11,478,810 B2
(45) Date of Patent: Oct. 25, 2022

(54) NOZZLE DEPOSIT REMOVING DEVICE AND METHOD OF NOZZLE DEPOSIT REMOVAL

(71) Applicant: HONDA MOTOR CO., LTD., Tokyo (JP)

(72) Inventor: Koji Oda, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 249 days.

(21) Appl. No.: 16/748,858

(22) Filed: Jan. 22, 2020

(65) Prior Publication Data

US 2020/0238326 A1 Jul. 30, 2020

(30) Foreign Application Priority Data

Jan. 29, 2019 (JP) ..... JP2019-012731

(51) Int. Cl.

| | |
|---|---|
| ***B05B 15/50*** | (2018.01) |
| *B08B 5/04* | (2006.01) |
| *B05B 15/555* | (2018.01) |

(52) U.S. Cl.

CPC ..... *B05B 15/50* (2018.02); *B05B 15/555* (2018.02); *B08B 5/04* (2013.01)

(58) Field of Classification Search

None

See application file for complete search history.

(56) References Cited

U.S. PATENT DOCUMENTS

2002/0029789 A1* 3/2002 Egashira ..... H01L 21/67051 134/2

FOREIGN PATENT DOCUMENTS

| | | |
|---|---|---|
| JP | 2007-216191 | 8/2007 |
| JP | 2011-078881 | 4/2011 |
| JP | 2015-066476 | 4/2015 |

OTHER PUBLICATIONS

Google Patents translation of JP2015066476A, retrieved from https://patents.google.com/patent/JP2015066476A/en?oq=JP+2015066476+ on Jan. 15, 2022. (Year: 2022).*

Japanese Office Action for Japanese Patent Application No. 2019-012731 dated Oct. 6, 2020, 8 pages.

* cited by examiner

*Primary Examiner* — Eric W Golightly

(74) *Attorney, Agent, or Firm* — Amin, Turocy & Watson, LLP

(57) ABSTRACT

In a nozzle deposit removing device and a method of nozzle deposit removal, compressed air is supplied to an air supply hole of a negative pressure generating unit from an air supply source, and compressed air is released to outside via an other end of a release hole from the air supply hole, thereby generating a flow of negative pressure directed from a tapered section of a nozzle insertion member toward the release hole via a through-hole. Next, a tip section of the nozzle is inserted into the tapered section of the nozzle insertion member, thereby forming a gap between the tapered section communicating with the through-hole and the tip section of the nozzle.

8 Claims, 7 Drawing Sheets

NOZZLE DEPOSIT REMOVING DEVICE AND METHOD OF NOZZLE DEPOSIT REMOVAL

CROSS-REFERENCE TO RELATED APPLICATION

This application is based upon and claims the benefit of priority from Japanese Patent Application No. 2019-012731 filed on Jan. 29, 2019, the contents of which are incorporated herein by reference.

BACKGROUND OF THE INVENTION

Field of the Invention

The present invention relates to a nozzle deposit removing device and a method of nozzle deposit removal for removing a deposit that has attached to a nozzle.

Description of the Related Art

In Japanese Laid-Open Patent Publication No. 2007-216191, for example, it is disclosed with regards to a nozzle for jetting a viscous liquid application material, that after use of the nozzle, a tip of the nozzle is inserted into an inverse conically shaped tapered section formed in a block, and compressed air is blown toward the tip of the nozzle, whereby the application material that has attached to the nozzle is blown off.

SUMMARY OF THE INVENTION

However, in the case where a gap between the nozzle and a blowout port of the compressed air is large, an air supply source of large supply pressure must be used in order to remove the application material that has attached to the tip of the nozzle. As a result, a device ends up increasing in size.

The present invention was made considering such a problem, and has an object of providing a nozzle deposit removing device and a method of nozzle deposit removal by which a deposit of a nozzle can be removed, without size of the device being increased.

Aspects of the present invention relate to a nozzle deposit removing device and a method of nozzle deposit removal for removing a deposit that has attached to a nozzle.

The nozzle deposit removing device comprises a nozzle insertion member, a fluid supply source, and a negative pressure generating unit. The nozzle insertion member includes: a tapered section on a side of one surface opposing the nozzle, of the nozzle insertion member, a diameter of the tapered section decreasing from the one surface side to a side of another surface of the nozzle insertion member, correspondingly to the nozzle; and a through-hole formed between a small diameter portion of the tapered section and the other surface, wherein a gap communicating with the through-hole is formed between the nozzle and the tapered section when a tip side of the nozzle has been inserted into the tapered section. The negative pressure generating unit includes: a release hole whose one end communicates with the through-hole, and whose other end communicates with outside; and a fluid supply hole by which the release hole and the fluid supply source are brought into communication with each other, wherein the negative pressure generating unit is configured to generate a flow of negative pressure directed from the tapered section toward the release hole via the through-hole, by a fluid supplied from the fluid supply source being released from the fluid supply hole to outside via the other end of the release hole.

The method of nozzle deposit removal comprises the steps of: with respect to a negative pressure generating unit that includes a release hole whose one end communicates with a through-hole of a nozzle insertion member, and a fluid supply hole communicating with the release hole, supplying a fluid from a fluid supply source to the release hole via the fluid supply hole, and releasing the fluid to outside via the other end of the release hole, thereby generating a flow of negative pressure directed from the through-hole toward the release hole; and in a case that the nozzle insertion member includes a tapered section whose diameter decreases from one surface side to another surface side of the nozzle insertion member, and the through-hole formed between the tapered section and the other surface, inserting a tip side of the nozzle into the tapered section, thereby forming a gap communicating with the through-hole between the nozzle and the tapered section.

Due to the present invention, when a fluid is supplied to the fluid supply hole from the fluid supply source, a flow of negative pressure directed from the tapered section toward the release hole via the through-hole is generated. When the tip side of the nozzle is inserted into the tapered section in this state, a gap matched to a shape of the tip side of the nozzle is formed between the tip side of the nozzle and the tapered section.

As a result, by a moderate fluid being supplied from the fluid supply source, the deposit of the nozzle can be sucked off by a negative pressure effect (a flow-straightening effect), and the tip side of the nozzle cleaned. In addition, by adjusting the gap, a flow speed of the negative pressure can be increased, and a greater negative pressure effect obtained. Moreover, if the tip side of the nozzle is gradually inserted into the tapered section after generation of the negative pressure, the flow speed of the negative pressure in the gap easily rises, hence a greater removal effect of the deposit is obtained.

Specifically, regarding a nozzle for applying a viscous application material, the application material (the deposit) that has attached to the nozzle can be efficiently sucked off, and the nozzle cleaned in a short time, after use of the nozzle. Moreover, work to wipe off the deposit from the nozzle using a sponge, or the like, is not required either.

Thus, in the present embodiment, the deposit of the nozzle can be efficiently (economically) removed, without size of the device being increased.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

A preferred embodiment of a nozzle deposit removing device and a method of nozzle deposit removal according to the present invention will be exemplified and described below with reference to the accompanying drawings.

1. Configuration of Present Embodiment

Figure 1:
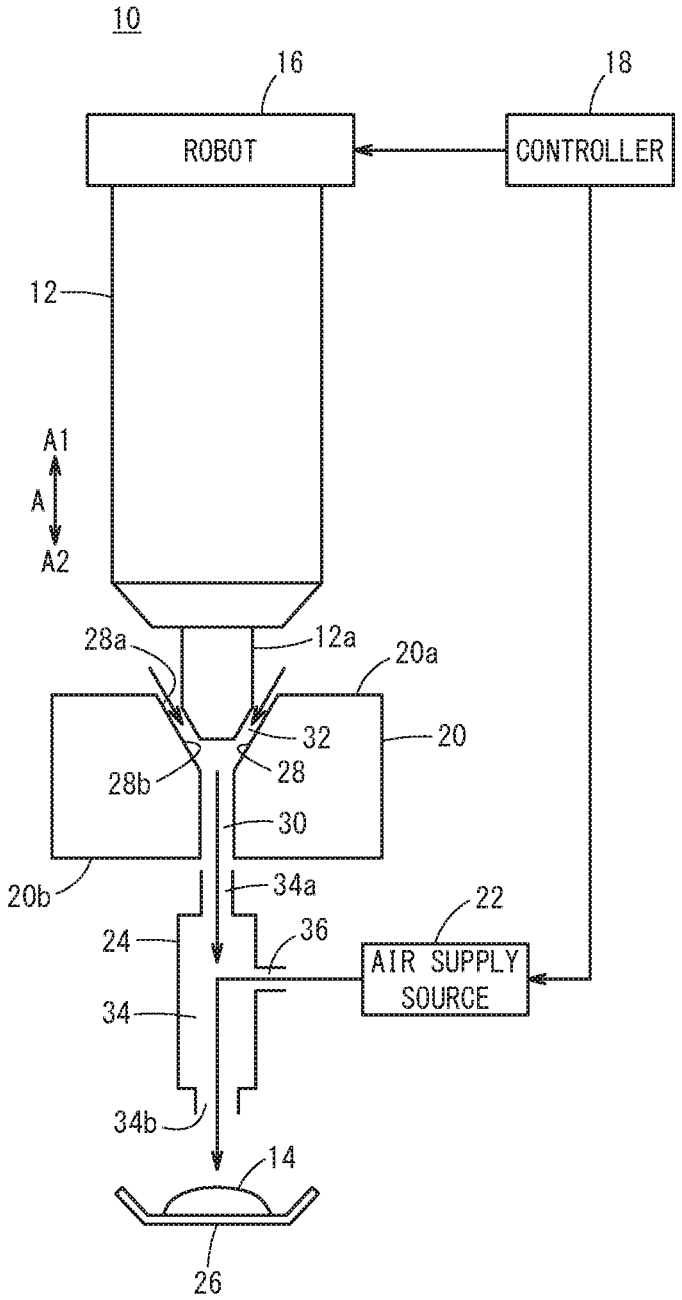
FIG. 1 is a configuration diagram conceptually illustrating a nozzle deposit removing device according to the present embodiment.

A nozzle deposit removing device 10 according to the present embodiment is used for removing a deposit 14 that has attached to a nozzle 12, as shown in FIG. 1. The nozzle 12 will be described here prior to description of the nozzle deposit removing device 10.

1.1 Outline of Nozzle 12

The nozzle 12 is mounted on a tip of an arm of a robot 16. The robot 16 operates according to an instruction from a controller 18. The nozzle 12, in a state of facing an unillustrated workpiece, jets a viscous liquid adhesive agent toward the workpiece from an opening section formed in a tip section 12*a* of the nozzle 12, and thereby applies the adhesive agent to the workpiece. After application work of the adhesive agent to the workpiece from the nozzle 12, the adhesive agent in liquid form or a solidified item of the residual adhesive agent attaches as the deposit 14 to a periphery of the tip section 12*a* of the nozzle 12 (a tip side of the nozzle 12).

1.2 Schematic Configuration of Nozzle Deposit Removing Device 10

The nozzle deposit removing device 10 according to the present embodiment is a device for removing the deposit 14 that has attached to the tip section 12*a* of the nozzle 12, and, as schematically illustrated by FIG. 1, comprises the previously mentioned controller 18, a nozzle insertion member 20, an air supply source 22 (a fluid supply source), a negative pressure generating unit 24, and a receiver tray 26.

The nozzle insertion member 20 is a conical basin-shaped (mortar-shaped) block having formed therein a tapered section 28 into which the tip section 12*a* of the nozzle 12 can be inserted. That is, the tapered section 28 has a shape whose diameter decreases from a side of one surface 20*a* (a surface in an A1 direction) of the nozzle insertion member 20 opposing the nozzle 12 to a side of another surface 20*b* (a surface in an A2 direction) of the nozzle insertion member 20, correspondingly to a shape of the tip section 12*a* of the nozzle 12, on the one surface 20*a* side. Hence, the one surface 20*a* side of the tapered section 28 is a large diameter portion 28*a*, and the other surface 20*b* side of the tapered section 28 is a small diameter portion 28*b*.

Moreover, in the nozzle insertion member 20, a through-hole 30 is formed along an A direction between the small diameter portion 28*b* of the tapered section 28 and the other surface 20*b*. When the tip section 12*a* of the nozzle 12 has been inserted into the tapered section 28 by operation of the robot 16, a gap 32 communicating with the through-hole 30 is formed between the tip section 12*a* of the nozzle 12 and the tapered section 28, as in FIG. 1.

The air supply source 22 supplies compressed air (a fluid) to the negative pressure generating unit 24, due to control from the controller 18.

The negative pressure generating unit 24 is a cylindrical mechanism, and includes: a release hole 34 formed in the A direction whose one end 34*a* communicates with the through-hole 30 and whose other end 34*b* communicates with outside; and an air supply hole 36 (a fluid supply hole) by which the release hole 34 and the air supply source 22 are brought into communication with each other.

In the case that the air supply source 22 has supplied compressed air to the release hole 34 via the air supply hole 36, the supplied compressed air flows in the A2 direction in the release hole 34, and is released to outside via the other end 34*b* of the release hole 34. As a result, a flow of negative pressure directed from the tapered section 28 toward the release hole 34 via the through-hole 30 is generated. In this case, if the tip section 12*a* of the nozzle 12 is inserted into the tapered section 28, the deposit 14 that has attached to the tip section 12*a* of the nozzle 12 is detached from the tip section 12*a* of the nozzle 12 and sucked into the release hole 34 via the through-hole 30 from the gap 32, due to the flow of negative pressure in the gap 32. The receiver tray 26 collects the deposit 14 that has been released to outside from the other end 34*b* of the release hole 34 together with the compressed air.

Note that a specific configuration of a negative pressure generating mechanism in the negative pressure generating unit 24 will be mentioned later. However, in practical terms, in order to generate a flow of negative pressure, it is adequate that a flow of compressed air directed obliquely downwardly is generated in the release hole 34 on the paper surface of FIG. 1, for example. As a result, a flow of negative pressure from the tapered section 28 to the release hole 34 via the through-hole 30 is generated. Moreover, in the present embodiment, it is possible to remove the deposit 14 that has attached to the tip side of the nozzle 12 (the periphery of the tip section 12*a* of the nozzle 12) including the tip section 12*a* of the nozzle 12. Hence, the tapered section 28 may have a shape matched to the tip side of the nozzle 12.

2. Operation of Present Embodiment

Next, operation of the nozzle deposit removing device 10 (the method of nozzle deposit removal) according to the present embodiment will be described with reference to FIG. 2. Note that in this description of operation, description will be made referring to FIG. 1 as required.

When application work of the adhesive agent to the workpiece from the nozzle 12 has ended, the deposit 14 being the adhesive agent in liquid form or a solidified item of the adhesive agent is attached to the tip section 12*a* of the nozzle 12. Accordingly, in step S1, the controller 18 drives the air supply source 22 and thereby supplies compressed air from the air supply source 22 to the release hole 34 via the air supply hole 36. The supplied compressed air is directed in the A2 direction, and is released to outside from the other end 34*b* of the release hole 34. Thus, air of the tapered section 28, the through-hole 30, and the release hole 34 moves in the A2 direction by being drawn by the compressed air flowing in the A2 direction. As a result, a flow of negative pressure in the A2 direction is generated in the tapered section 28, the through-hole 30, and the release hole 34.

In step S2, the controller 18 moves the robot 16, and gradually inserts the tip section 12*a* of the nozzle 12 into the tapered section 28 of the nozzle insertion member 20. As a result, the gap 32 is formed between the tip section 12*a* of the nozzle 12 and the tapered section 28, and the gap 32 communicates with the through-hole 30. In this case, the flow of negative pressure is already being generated, hence the smaller an interval of the gap 32 becomes, the more a flow speed of the negative pressure rises.

In step S3, the deposit 14 that has attached to the tip section 12*a* of the nozzle 12 is detached due to the flow of negative pressure generated in the gap 32. In step S4, the detached deposit 14 is sucked into the release hole 34 via the through-hole 30 from the gap 32, in accordance with the flow of negative pressure. The sucked-in deposit 14 flows in the A2 direction in the release hole 34, and is released to outside from the other end 34*b* of the release hole 34. The released deposit 14 is collected in the receiver tray 26.

Note that in steps S3 and S4, it is desirable that the tip section 12*a* of the nozzle 12 be further inserted into the tapered section 28 and that the interval of the gap 32 be set constant, according to detachment of the deposit 14 from the tip section 12*a* of the nozzle 12. That is, if the deposit 14 detaches from the tip section 12*a* of the nozzle 12, the interval of the gap 32 increases, and the flow speed of the negative pressure drops. Accordingly, by adjusting the interval of the gap 32 to be constant, the flow speed of the negative pressure is maintained.

When the deposit 14 has been removed from the tip section 12*a* of the nozzle 12, in step S5, the controller 18 stops drive of the air supply source 22. As a result, supply of compressed air to the release hole 34 via the air supply hole 36 from the air supply source 22 is stopped, and the flow of negative pressure disappears, leading to stoppage of a sucking operation of the deposit 14.

In step S6, the controller 18 operates the robot 16 to withdraw the tip section 12*a* of the nozzle 12 from the tapered section 28 of the nozzle insertion member 20. As a result, cleaning work to remove the deposit 14 from the nozzle 12 ends, and the nozzle 12 is enabled to suitably execute application work of the adhesive agent to the workpiece.

3. Specific Example

Next, a specific example of the nozzle deposit removing device 10 conceptually described by FIG. 1 will be described with reference to FIGS. 3 and 4. Here, specific examples of the nozzle insertion member 20 and negative pressure generating unit 24, of the nozzle deposit removing device 10 will be illustrated.

The nozzle insertion member 20 comprises, sequentially along its A2 direction: a block 40 made of a resin (for example, PTFE (polytetrafluoroethylene)), that includes the tapered section 28; a thin plate 42 made of a metal; and a bracket 44 made of a metal, that has a substantially T-shaped cross section.

The tapered section 28 is formed in a center section of the block 40. A hole 46 that opens in a bottom surface in the A2 direction of the block 40, is formed in the small diameter portion 28*b* of the tapered section 28. Moreover, as shown in FIG. 4, a plurality of groove sections 50 extend radially from the hole 46 (the small diameter portion 28*b*) toward the large diameter portion 28*a*, in a wall surface 48 of the tapered section 28, in planar view looking from the nozzle 12. FIG. 4 illustrates the case of eight groove sections 50 extending radially at intervals of substantially 45° around the hole 46.

It is adequate that the wall surface 48 of the tapered section 28 has at least one groove section 50 formed therein. Moreover, the wall surface 48 of the tapered section 28 is formed as a seat section 52 on which part of the tip section 12*a* of the nozzle 12 is seated when the tip section 12*a* of the nozzle 12 has been inserted into the tapered section 28. Hence, when the tip section 12*a* of the nozzle 12 has been seated on the seat section 52, the gap 32 communicating with the hole 46 is formed between an outer circumferential surface of the tip section 12*a* of the nozzle 12 and the groove section 50.

The plate 42 is sandwiched between the block 40 and the bracket 44. A hole 54 that communicates with the hole of the block 40 is formed in a center section of the plate 42.

The bracket 44 includes: a main body section 44*a* extending in the A direction; and a flange 44*b* provided to an end section in the A1 direction of the main body section 44*a*. The flange 44*b*, together with the block 40, encloses the plate 42. The main body section 44*a* has formed therein in the A direction a communicating hole 56 that communicates with the hole 54 of the plate 42 and has a larger diameter than the hole 46 of the block 40 and the hole 54 of the plate 42.

Now, the hole 46 of the block 40, the hole 54 of the plate 42, and the communicating hole 56 of the bracket 44 configure the previously mentioned through-hole 30. Note that the block 40 is fastened to the bracket 44, via the plate 42, by screw members 58.

Figure 3:
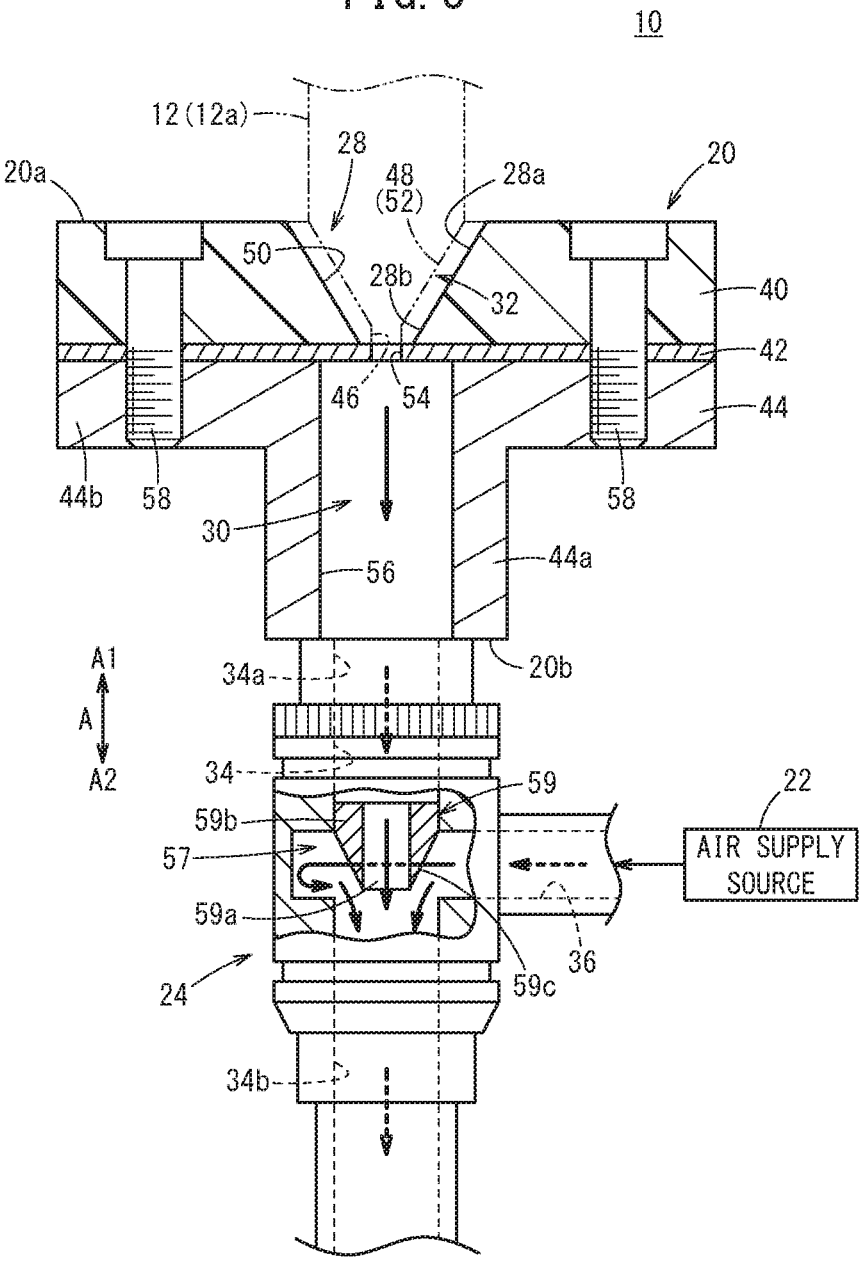
FIG. 3 is a configuration diagram illustrating a specific configuration of the nozzle deposit removing device of FIG. 1.
Figure 4:
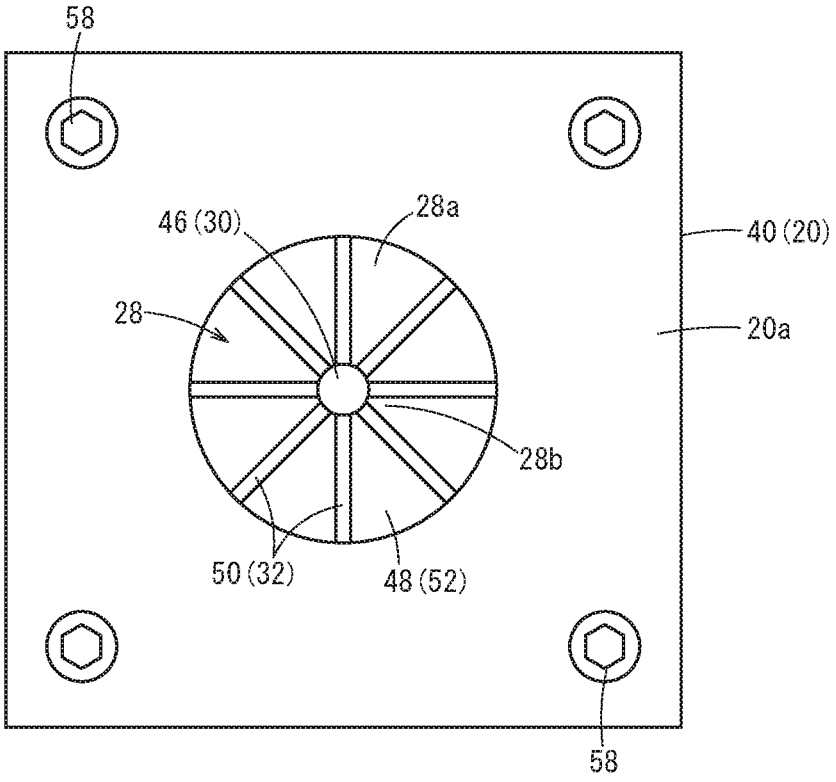
FIG. 4 is a plan view of a nozzle insertion member of FIG. 3 viewed from a nozzle side.

The negative pressure generating unit 24 is configured as a substantially T-shaped pipe line member in side view of FIG. 3. The negative pressure generating unit 24 has formed on its inside: the release hole 34 that extends in the A direction and communicates with the communicating hole 56 of the bracket 44; and the air supply hole 36 that communicates the release hole 34 and the air supply source 22.

In the negative pressure generating unit 24, a cylindrical member 59 is arranged in a coupling place 57 of the release hole 34 and the air supply hole 36. The cylindrical member 59 is provided in the release hole 34 so as to project into the coupling place 57 from a side of the one end 34*a* of the release hole 34. The cylindrical member 59 includes a communicating hole 59*a* that communicates the one end 34*a* side and the other end 34*b* side of the release hole 34. Moreover, a base end portion 59*b* on the A1 direction side of the cylindrical member 59 is fixed to an inner circumferential surface of the negative pressure generating unit 24. Furthermore, in the cylindrical member 59, an outer circumferential surface 59*c* of a tip portion on the A2 direction side projecting into the coupling place 57 is formed in a tapered shape whose diameter decreases toward the A2 direction side. Note that in order for the cylindrical member 59 to be arranged in the coupling place 57, the coupling place 57 is formed in the negative pressure generating unit 24 as a cavity portion larger in a radial direction than the release hole 34 is.

On the other hand, the air supply hole 36 communicates with the release hole 34 at the coupling place 57, so as to face the outer circumferential surface 59*c* of the cylindrical member 59. In this case, the cylindrical member 59 is arranged so as to block the coupling place 57 and the side of the one end 34*a* of the release hole 34, when viewed from the air supply hole 36. Moreover, the outer circumferential surface 59*c* of the cylindrical member 59 inclines obliquely downwardly toward the other end 34*b* of the release hole 34 from the air supply hole 36 on the paper surface of FIG. 3.

Figure 2:
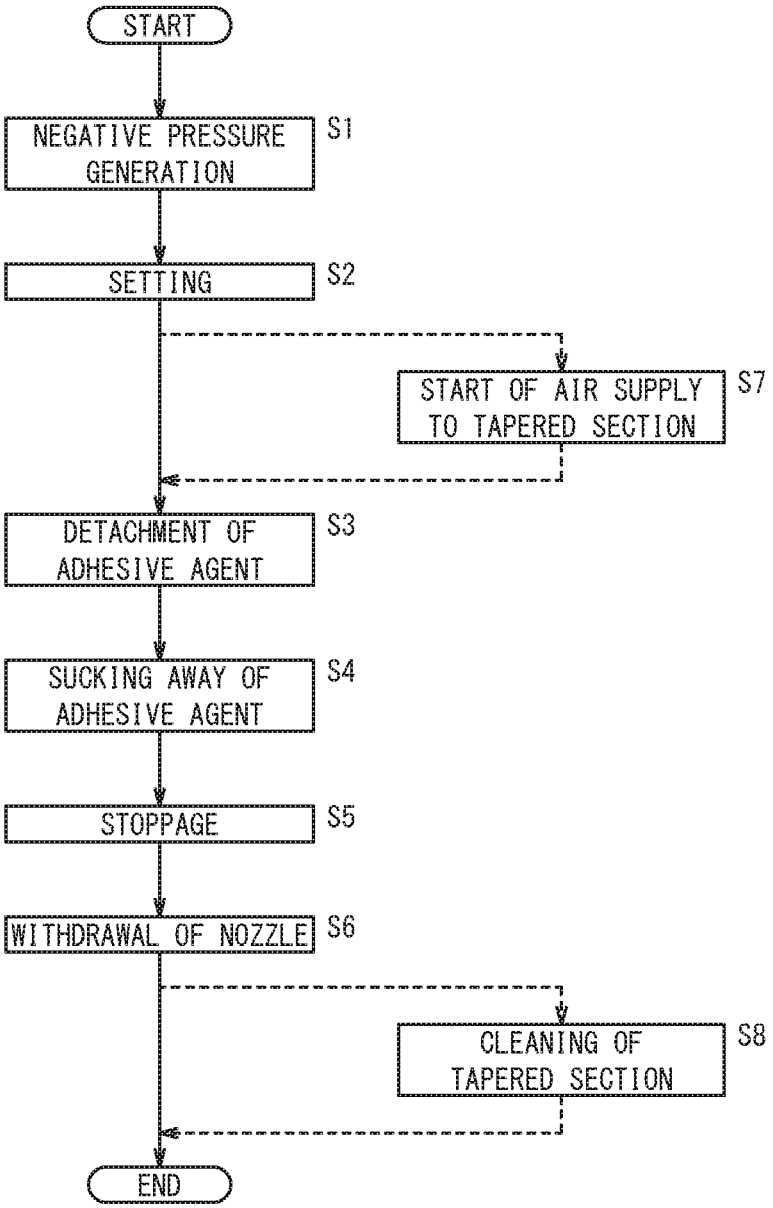
FIG. 2 is a flowchart showing operation of the nozzle deposit removing device of FIG. 1 (a method of nozzle deposit removal)

In this specific example too, cleaning work to suitably remove the deposit 14 that has attached to the tip section 12*a* of the nozzle 12 can be performed according to the flowchart of FIG. 2. That is, in step S1, when compressed air is supplied to the coupling place 57 via the air supply hole 36 from the air supply source 22, the compressed air flows toward the other end 34*b* of the release hole 34 along the outer circumferential surface 59*c* of the cylindrical member 59, as shown by the arrows in FIG. 3.

Thus, air of the communicating hole 59*a* is drawn by the compressed air flowing in the A2 direction, and moves in the A2 direction. As a result, air on the side of the one end 34*a* of the release hole 34, air of the through-hole 30, and air of the tapered section 28 also move in the A2 direction, and a flow of negative pressure is generated.

In step S2, when the tip section 12*a* of the nozzle 12 is gradually inserted into the tapered section 28, the gaps 32 are respectively formed between each of the groove sections 50 and the tip section 12*a* of the nozzle 12. In this case, the smaller the interval of each of the gaps 32 becomes, the more the flow speed of the negative pressure rises.

Moreover, the plurality of gaps 32 are formed by the plurality of groove sections 50, so even if the tip section 12*a* of the nozzle 12 is seated on the seat section 52 of the tapered section 28, air flow (the flow of negative pressure) is maintained by each of the groove sections 50. Thus, by adjusting a size of the groove section 50, the flow speed of the negative pressure can be easily controlled. Hence, if the flow speed of the negative pressure is increased, the deposit 14 can be detached from the tip section 12*a* of the nozzle 12 and sucked away, due to a larger negative pressure effect (steps S3 and S4).

Note that the plurality of groove sections 50 are provided at intervals of a certain angle. Therefore, by the controller 18 moving the robot 16 and axially rotating the nozzle 12, the deposit 14 that has attached to an outer circumferential surface of the tip section 12*a* of the nozzle 12 can be certainly detached and sucked away.

4. Modified Examples

Next, modified examples (a first modified example and a second modified example) of the nozzle deposit removing device 10 according to the present embodiment will be described with reference to FIGS. 5-7.

4.1 First Modified Example

Figure 5:
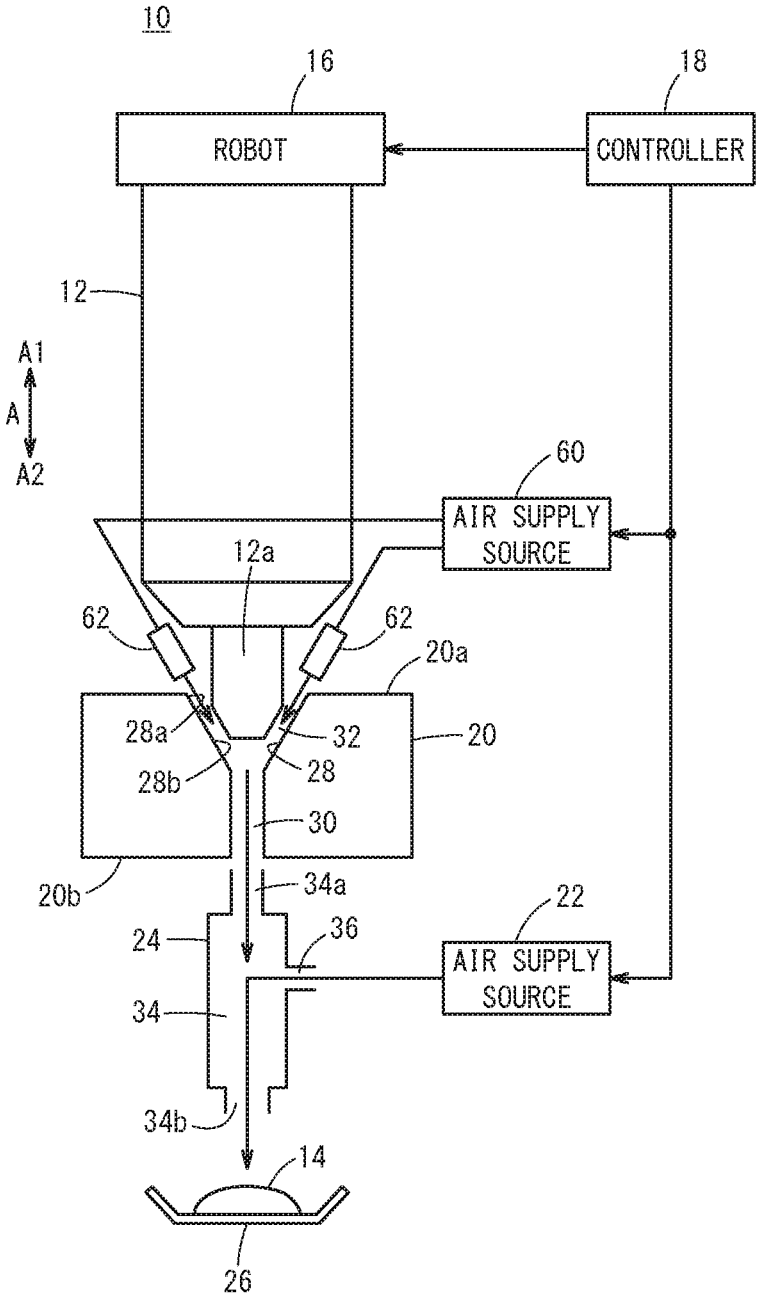
FIG. 5 is a configuration diagram of a first modified example.
Figure 6:
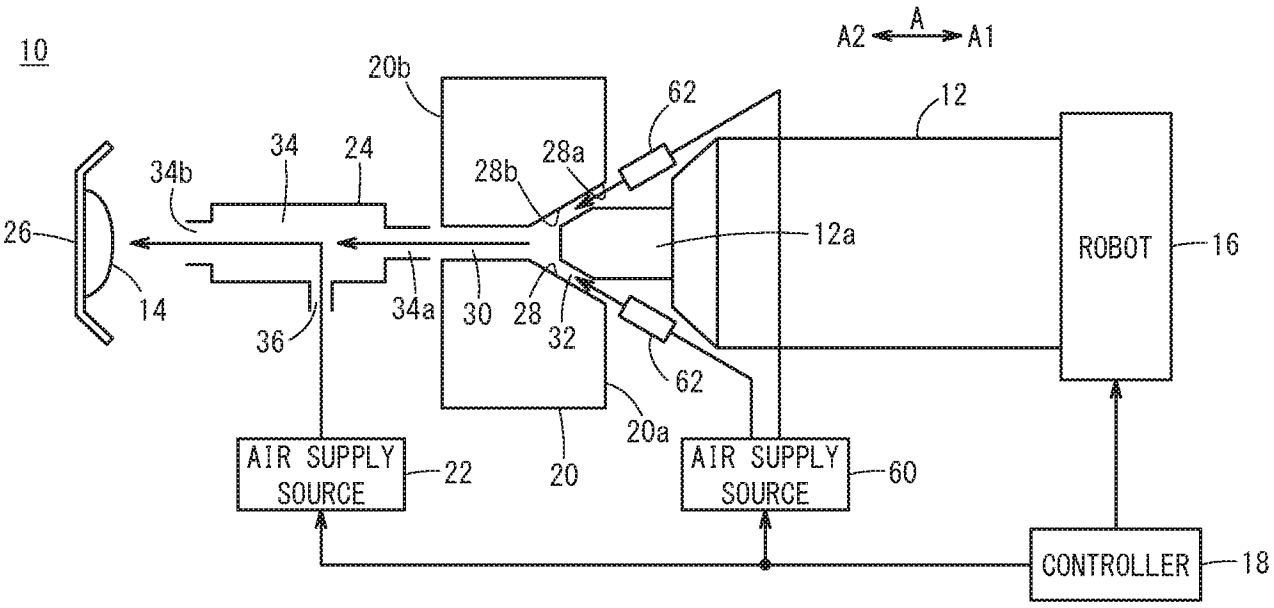
FIG. 6 is a configuration diagram of a second modified example.

In the first modified example shown in FIG. 5, another air supply source 60 and an air blow nozzle 62 (a fluid supplying unit) connected to the other air supply source 60 are provided.

Moreover, in the first modified example, after step S2 of FIG. 2, operation proceeds to step S7, and the controller 18 drives the other air supply source 60, and starts supply of compressed air to the air blow nozzle 62 from the other air supply source 60. The air blow nozzle 62 is disposed in a vicinity of the large diameter portion 28*a* of the tapered section 28, and the compressed air supplied from the other air supply source 60 is jetted (supplied) toward the through-hole 30 via the gap 32 from the large diameter portion 28*a* of the tapered section 28.

Thus, in step S3, the deposit 14 that has attached to the tip section 12*a* of the nozzle 12 is certainly detached, due to the flow of negative pressure and the compressed air jetted from the air blow nozzle 62. As a result, in step S4, the detached deposit 14 is sucked into the release hole 34 from the through-hole 30, and is collected in the receiver tray 26 from the other end 34*b* of the release hole 34. Then, in step S5, the controller 18 stops drive of the other air supply source 60, and stops jetting of compressed air from the air blow nozzle 62.

Incidentally, sometimes, due to removal work (cleaning work) of the deposit 14 of the nozzle 12, part of the deposit 14 that has detached from the tip section 12*a* of the nozzle 12 attaches to the tapered section 28. Accordingly, in step S6 and step S8, the controller 18 drives again the other air supply source 60, and restarts supply of compressed air to the large diameter portion 28*a* of the tapered section 28 from the air blow nozzle 62. As a result, the deposit 14 that has attached to the tapered section 28 is detached from the tapered section 28 by compressed air jetted from the air blow nozzle 62, and is collected in the receiver tray 26 via the release hole 34 from the through-hole 30.

Note that in step S8, the controller 18 may drive again the air supply source 22 and generate a flow of negative pressure, thereby removing the deposit 14 that has attached to the tapered section 28 by supply of compressed air from the air blow nozzle 62 and by the negative pressure effect. Alternatively, in step S8, the controller 18 may drive again only the air supply source 22, and remove the deposit 14 that has attached to the tapered section 28 by the negative pressure effect.

Furthermore, in the first modified example, by execution of step S7, compressed air is supplied to the tapered section 28 from the air blow nozzle 62 even during removal of the deposit 14 of steps S3 and S4. It is thus possible for removal of the deposit 14 that has attached to the tapered section 28 to also be simultaneously performed along with removal of the deposit 14 from the nozzle 12.

4.2 Second Modified Example

FIGS. 1-5 have described the case where the tip section 12*a* of the nozzle 12 is inserted into the tapered section 28 by operating the robot 16. The second modified example shows an example where, in the case that the nozzle 12 mounted on the robot 16 is disposed in a fixed position (a position that application work is performed by the nozzle 12), the deposit 14 of the tip section 12*a* of the nozzle 12 is removed by moving the nozzle deposit removing device 10 and surrounding the tip section 12*a* of the nozzle 12 by the tapered section 28. FIG. 6 illustrates the case where the nozzle 12 is disposed substantially horizontally.

In the second modified example too, removal work (cleaning work) of the deposit 14 can be performed similarly to in the case of FIGS. 1-5. Now, it should be noted that in the second modified example, the nozzle insertion member 20 and the negative pressure generating unit 24 are disposed in a horizontal direction matching the position of the nozzle 12, so the receiver tray 26 collects the deposit 14 released to outside from the other end 34*b* of the release hole 34 extending in the horizontal direction.

Figure 7:
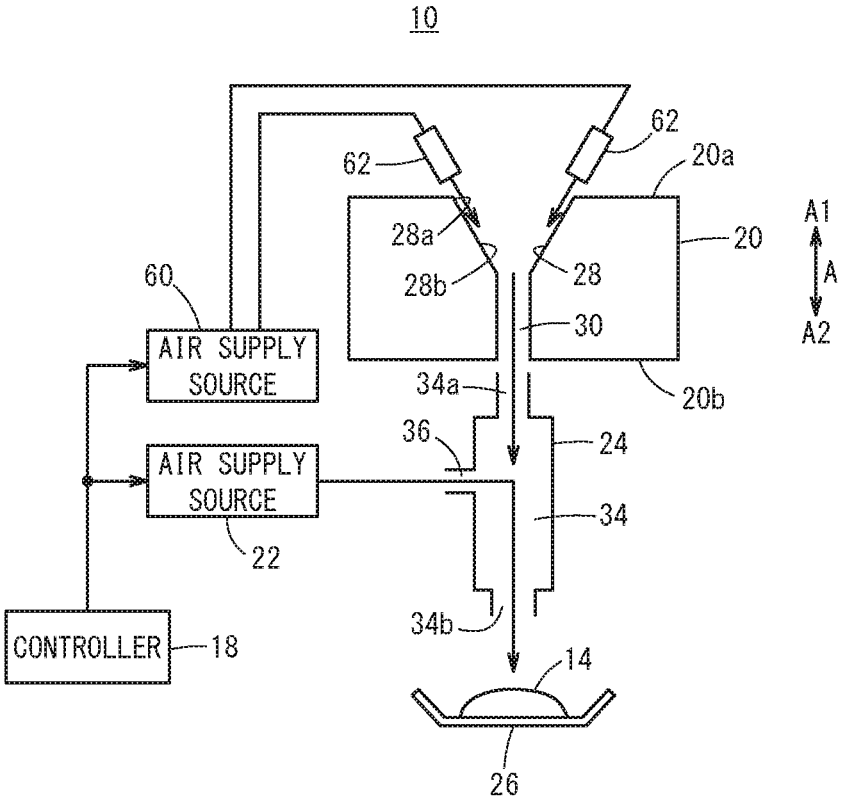
FIG. 7 is a configuration diagram of the second modified example.

Moreover, in the second modified example, as shown in FIG. 7, it is adequate that the deposit 14 which has attached to the tapered section 28 is removed in step S8 of FIG. 2 in a state where the nozzle insertion member 20 and the negative pressure generating unit 24 have been disposed in an up-down direction.

5. Advantages of Present Embodiment

As described above, the nozzle deposit removing device 10 according to the present embodiment comprises the nozzle insertion member 20, the air supply source 22 (the fluid supply source), and the negative pressure generating unit 24. The nozzle insertion member 20 includes: the tapered section 28 on a side of the one surface 20*a* opposing the nozzle 12, of the nozzle insertion member 20, the diameter of the tapered section 28 decreasing from the one surface 20*a* side to a side of the other surface 20*b* of the nozzle insertion member 20, correspondingly to the nozzle 12; and the through-hole 30 formed between the small diameter portion 28*b* of the tapered section 28 and the other surface 20*b*, the gap 32 communicating with the through-hole 30 being formed between the nozzle 12 and the tapered section 28 when the tip section 12*a* of the nozzle 12 (the tip side of the nozzle 12) has been inserted into the tapered section 28. The negative pressure generating unit 24 includes: the release hole 34 whose one end 34*a* communicates with the through-hole 30, and whose other end 34*b* communicates with outside; and the air supply hole 36 (the fluid supply hole) by which the release hole 34 and the air supply source 22 are brought into communication with each other, and the negative pressure generating unit 24 is configured to generate a flow of negative pressure directed from the tapered section 28 toward the release hole 34 via the through-hole 30, by compressed air (the fluid) supplied from the air supply source 22 being released from the air supply hole 36 to outside via the other end 34*b* of the release hole 34.

Moreover, the method of nozzle deposit removal according to the present embodiment comprises the steps of: with respect to the negative pressure generating unit 24 that includes the release hole 34 whose one end 34*a* communicates with the through-hole 30 of the nozzle insertion member 20, and the air supply hole 36 communicating with the release hole 34, supplying compressed air from the air supply source 22 to the release hole 34 via the air supply hole 36, and releasing the compressed air to outside via the other end 34*b* of the release hole 34, thereby generating a flow of negative pressure directed from the through-hole 30 toward the release hole 34 (step S1); and in the case that the nozzle insertion member 20 includes the tapered section 28 whose diameter decreases from the one surface 20*a* side to the other surface 20*b* side of the nozzle insertion member 20, and the through-hole 30 formed between the tapered section 28 and the other surface 20*b*, inserting the tip section 12*a* of the nozzle 12 into the tapered section 28, thereby forming the gap 32 communicating with the through-hole 30 between the nozzle 12 and the tapered section 28 (step S2).

Thus, when compressed air is supplied to the air supply hole 36 from the air supply source 22, a flow of negative pressure directed from the tapered section 28 toward the release hole 34 via the through-hole 30 is generated. When the tip section 12*a* of the nozzle 12 is inserted into the tapered section 28 in this state, the gap 32 matched to a shape of the tip section 12*a* of the nozzle 12 is formed between the tip section 12*a* of the nozzle 12 and the tapered section 28.

As a result, by a moderate compressed air being supplied from the air supply source 22, the deposit 14 of the nozzle 12 can be sucked off by a negative pressure effect (a flow-straightening effect), and the nozzle 12 cleaned. In addition, by adjusting the gap 32, the flow speed of the negative pressure can be increased, and a greater negative pressure effect obtained. Moreover, if the tip section 12*a* of the nozzle 12 is gradually inserted into the tapered section 28 after generation of the negative pressure, the flow speed of the negative pressure in the gap 32 easily rises, hence a greater removal effect of the deposit 14 is obtained.

Specifically, regarding a nozzle 12 for applying a viscous application material (the adhesive agent) to a workpiece, the application material (the deposit 14) that has attached to the nozzle 12 can be efficiently sucked off, and the nozzle 12 cleaned in a short time, after use of the nozzle 12. Moreover, work to wipe off the deposit 14 from the nozzle 12 using a sponge, or the like, is not required either. Thus, in the present embodiment, the deposit 14 of the nozzle 12 can be efficiently (economically) removed, without size of the device being increased.

In addition, the tapered section 28 includes: the seat section 52 being the wall surface 48 of the tapered section 28 on which part of the tip section 12*a* of the nozzle 12 is seated when the tip section 12*a* of the nozzle 12 has been inserted into the tapered section 28; and at least one groove section 50 that is formed in the wall surface 48, communicates with the through-hole 30, and forms the gap 32 when the tip section 12*a* of the nozzle 12 has been inserted into the tapered section 28. As a result, the flow of negative pressure can be maintained by the groove section 50, even when the tip section 12*a* of the nozzle 12 is seated on the seat section 52. Moreover, the gap 32 can be easily formed, and, by changing the size of the groove section 50, the flow speed of the negative pressure can be easily adjusted.

Furthermore, when the through-hole 30 is viewed from the nozzle 12, a plurality of the groove sections 50 extend radially from the through-hole 30, in the wall surface 48 of the tapered section 28. This makes it possible for the deposit 14 that has attached to the outer circumferential surface of the tip section 12*a* of the nozzle 12 to be certainly and efficiently removed due to the negative pressure effect, while axially rotating the nozzle 12.

In addition, the nozzle deposit removing device 10 further comprises the other air supply source 60 and the air blow nozzle 62 (the fluid supplying unit) configured to supply compressed air (the fluid) toward the through-hole 30 from the large diameter portion 28*a* of the tapered section 28. As a result, the deposit 14 of the tip section 12*a* of the nozzle 12 can be even more efficiently and certainly removed due to the negative pressure effect by the negative pressure generating unit 24 and due to the compressed air jetted from the air blow nozzle 62.

Moreover, if, when the tip section 12*a* of the nozzle 12 has been separated from the tapered section 28, the air blow nozzle 62 supplies compressed air toward the through-hole 30 from the large diameter portion 28*a* of the tapered section 28, or the air supply source 22 supplies fluid to the release hole 34 from the air supply hole 36, then cleaning work to remove the deposit 14 that is attached to the tapered section 28 can be executed after removal work of the deposit 14 of the nozzle 12.

In addition, by the air blow nozzle 62 supplying fluid toward the through-hole 30 from the large diameter portion 28*a* of the tapered section 28 when the tip section 12*a* of the nozzle 12 is being inserted into the tapered section 28, the deposit 14 of the tip section 12*a* of the nozzle 12 can be even more efficiently and certainly removed. Moreover, it also becomes possible for removal of the deposit 14 from the tip section 12*a* of the nozzle 12 and removal of the deposit 14 that has attached to the tapered section 28 to be simultaneously performed.

Furthermore, if at least a portion of the nozzle insertion member 20 where the tapered section 28 is formed, is made of a resin, then it can be avoided that the deposit 14 being the adhesive agent closely attaches to the tapered section 28, and it can be avoided that the tip section 12*a* of the nozzle 12 is damaged during removal work of the deposit 14.

Moreover, the air supply source 22 is configured to begin supply of compressed air to the release hole 34 from the air supply hole 36, prior to insertion of the tip section 12*a* of the nozzle 12 into the tapered section 28. As a result, the flow speed of the negative pressure in the gap 32 can be easily raised as the interval of the gap 32 decreases when the tip section 12*a* of the nozzle 12 is gradually inserted into the tapered section 28. Thus, a greater removal effect of the deposit 14 is obtained.

Moreover, the negative pressure generating unit 24 includes the communicating hole 59*a* provided in the coupling place 57 of the release hole 34 and the air supply hole 36 and communicating the one end 34*a* side and the other end 34*b* side of the release hole 34, and further includes the cylindrical member 59 having an outer circumferential surface 59*c*, a diameter of the outer circumferential surface 59*c* decreasing from the one end 34*a* side to the other end 34*b* side of the release hole 34. The air supply hole 36 communicates with the release hole 34 so as to face the outer circumferential surface 59*c* of the cylindrical member 59.

As a result, compressed air supplied to the coupling place 57 via the air supply hole 36 from the air supply source 22 flows toward the other end 34*b* of the release hole 34 obliquely downwardly along the outer circumferential surface 59*c* on the paper surface of FIG. 3. Thus, air of the communicating hole 59*a*, air on the one end 34*a* side of the release hole 34, air of the through-hole 30, and air of the tapered section 28 flow to the other end 34*b* side of the release hole 34 by being drawn by the compressed air. As a result, the flow of negative pressure can be easily and efficiently generated.

Note that the present invention is not limited to the above-mentioned embodiment, and that, of course, a variety of configurations may be adopted based on the described content of this specification.

What is claimed is:

1. A nozzle deposit removing device for removing a deposit that has attached to a nozzle, comprising:

a nozzle insertion member including: a tapered section on a side of one surface opposing the nozzle, of the nozzle insertion member, a diameter of the tapered section decreasing from the one surface side to a side of another surface of the nozzle insertion member, correspondingly to the nozzle; and a through-hole formed between a small diameter portion of the tapered section and the other surface, wherein a gap communicating with the through-hole is formed between the nozzle and the tapered section when a tip side of the nozzle has been inserted into the tapered section;

a fluid supply source; and a negative pressure generating unit including: a release hole whose one end communicates with the through-hole, and whose other end communicates with outside; and a fluid supply hole by which the release hole and the fluid supply source are brought into communication with each other, wherein the negative pressure generating unit is configured to generate a flow of negative pressure directed from the tapered section toward the release hole via the through-hole, by a fluid supplied from the fluid supply source being released from the fluid supply hole to outside via the other end of the release hole, wherein the tapered section includes:

a seat section being a wall surface of the tapered section on which part of the tip side of the nozzle is seated when the tip side of the nozzle has been inserted into the tapered section; and at least one groove section that is formed in the wall surface, communicates with the through-hole, and forms the gap when the tip side of the nozzle has been inserted into the tapered section.

2. The nozzle deposit removing device according to claim 1, wherein when the through-hole is viewed from the nozzle, a plurality of the groove sections extend radially from the through-hole, in the wall surface.

3. The nozzle deposit removing device according to claim 1, further comprising a fluid supplying unit configured to supply a fluid toward the through-hole from a large diameter portion of the tapered section.

4. The nozzle deposit removing device according to claim 3, wherein when the tip side of the nozzle has been separated from the tapered section, the fluid supplying unit supplies a fluid toward the through-hole from the large diameter portion of the tapered section, or the fluid supply source supplies a fluid to the release hole from the fluid supply hole.

5. The nozzle deposit removing device according to claim 3, wherein the fluid supplying unit supplies a fluid toward the through-hole from the large diameter portion of the tapered section when the tip side of the nozzle is being inserted into the tapered section.

6. The nozzle deposit removing device according to claim 1, wherein at least a portion of the nozzle insertion member where the tapered section is formed, is made of a resin.

7. The nozzle deposit removing device according to claim 1, wherein the fluid supply source is configured to begin supply of the fluid to the release hole from the fluid supply hole, prior to insertion of the tip side of the nozzle into the tapered section.

8. The nozzle deposit removing device according to claim 1, wherein the negative pressure generating unit includes a communicating hole provided in a coupling place of the release hole and the fluid supply hole and communicating with one end side and another end side of the release hole, and further includes a cylindrical member having an outer circumferential surface, a diameter of the outer circumferential surface decreasing from the one end side to the other end side of the release hole, and the fluid supply hole communicates with the release hole so as to face the outer circumferential surface of the cylindrical member.

* * * * *